US007719196B2

(12) United States Patent
Okamoto

(10) Patent No.: US 7,719,196 B2
(45) Date of Patent: May 18, 2010

(54) STRUCTURE OF COAXIAL-TO-WAVEGUIDE TRANSITION AND TRAVELING WAVE TUBE

(75) Inventor: Koji Okamoto, Sagamihara (JP)

(73) Assignee: NEC Microwave Tube, Ltd., Kanagawa (JP)

( * ) Notice: Subject to any disclaimer, the term of this patent is extended or adjusted under 35 U.S.C. 154(b) by 0 days.

(21) Appl. No.: 12/099,483

(22) Filed: Apr. 8, 2008

(65) Prior Publication Data

US 2008/0246553 A1 Oct. 9, 2008

(30) Foreign Application Priority Data

Apr. 9, 2007 (JP) ..... 2007-101713

(51) Int. Cl.
*H01J 23/48* (2006.01)
*H01P 5/103* (2006.01)

(52) U.S. Cl. ..... 315/39.3; 333/26; 333/34

(58) Field of Classification Search ..... 315/39.3; 333/26, 34

See application file for complete search history.

(56) References Cited

U.S. PATENT DOCUMENTS 3,707,647 A * 12/1972 Rawls, Jr. ..... 315/3.5
4,144,506 A * 3/1979 McCammon et al. ..... 333/26

FOREIGN PATENT DOCUMENTS

JP 5-23397 U 3/1993

* cited by examiner

*Primary Examiner*—Benny Lee
(74) *Attorney, Agent, or Firm*—Sughrue Mion, PLLC

(57) ABSTRACT

The present invention includes a waveguide for outputting radio frequency wave, a vacuum envelope provided with a slow-wave circuit, a coaxial connection part connecting the waveguide and the vacuum envelope, an insulating window member which is provided in the coaxial connection part and which hermetically seals a said of vacuum envelope and a said of waveguide, a coaxial center conductor of exterior portion with one end supported by the waveguide, and a coaxial center conductor of an interior portion with one end abutting on the slow-wave circuit and the other end connected to the coaxial center conductor of the exterior portion. The waveguide is provided with a screw part supporting the coaxial center conductor of the exterior portion movably in an axial direction of the coaxial center conductor of the exterior portion. An end portion of the coaxial center conductor of the exterior portion is connected to the end portion of the coaxial center conductor of the interior portion movably in the axial direction of the coaxial center conductor of the exterior portion.

8 Claims, 5 Drawing Sheets

STRUCTURE OF COAXIAL-TO-WAVEGUIDE TRANSITION AND TRAVELING WAVE TUBE

This application is based upon and claims the benefit of priority from Japanese Patent Application No. 2007-101713 filed on Apr. 9, 2007, the content of which is incorporated by reference.

BACKGROUND OF THE INVENTION

1. Field of the Invention

The present invention relates to a structure of a coaxial-to-waveguide transition for an input and/or output of radio frequency signals, and a traveling wave tube including the structure of the coaxial-to-waveguide transition.

2. Description of the Related Art

Conventionally, a traveling wave tube is known as a microwave tube. Many traveling wave tubes include structures of coaxial-to-waveguides transition as input window in which a radio frequency wave is inputted, or output window from which a radio frequency wave is outputted.

The output window included in a traveling wave tube related to the present invention is disclosed, for example, in Japanese Utility Model Laid-Open No. 5-23397 (see FIG. 1). As shown in FIG. 1, output transition section 101 included by the traveling wave tube related to the present invention is configured by including waveguide 106 for outputting radio frequency wave, vacuum envelope 107 provided with slow-wave circuit 108 in the interior of the vacuum, insulating window member 109 which hermetically seals a side of vacuum envelope 107 and a side of waveguide 106, a coaxial connection portion 110 which connects the waveguide 106 and the vacuum envelope 107, coaxial center conductor of exterior portion 111 with one end supported by waveguide 106, and coaxial center conductor of interior portion 112 with one end abutting on slow-wave circuit 108 and the other end connected to the coaxial center conductor of exterior portion 111.

In such a traveling wave tube, the matching property in the vicinity of insulating window member 109 is determined by the characteristic impedance set by the size of the component parts including the coaxial center conductor of exterior portion 111. In the output transition section, in order to reduce the return loss of an amplified radio frequency wave, impedance in the output transition section needs to be adjusted to be optimal.

Incidentally, each of the components configuring the output transition section inevitably causes variation in the outside dimensions, such as the length and the outside diameter due to machining accuracy, dimensional tolerance and the like. Therefore, in the configuration of the output transition section related to the present invention, in order to adjust the characteristic impedance to a desired optimal value, a plurality of components differing in outside dimensions are prepared when manufacturing the individual output transition sections, and the components from which the optimal impedance value is obtained are selected and assembled from a plurality of components. Therefore, there are disadvantages in that the operation of adjusting impedance is complicated, and manufacturing costs increase.

SUMMARY OF THE INVENTION

An object of the present invention is to provide a structure of a coaxial-to-waveguide that is transition capable of easily adjusting the characteristic impedance by a coaxial center conductor of exterior portion, and a traveling wave tube.

In order to attain the above-described object, a structure of a coaxial-to-waveguide transition according to the present invention includes a waveguide for inputting or outputting a radio frequency wave, a vacuum envelope provided with a slow-wave circuit, a coaxial connection part connecting the waveguide and the vacuum envelope, an insulating and sealing member which is provided in the coaxial connection part and which hermetically seals a side of vacuum envelope and a side of waveguide, a coaxial center conductor of an exterior portion with one end supported by the waveguide, and a coaxial center conductor of an interior portion with one end abutting on the slow-wave circuit and the other end connected to the coaxial center conductor of an exterior portion. The waveguide is provided with a screw part supporting the coaxial center conductor of the exterior portion movably in an axial direction of the coaxial center conductor of exterior portion. An end of the coaxial center conductor of the exterior portion is connected to an end of the coaxial center conductor of the interior portion movably in an axial direction of the coaxial center conductor of the exterior portion.

The structure of the coaxial-to-waveguide transition according to the present invention configured as described above moves the end of the coaxial center conductor of the exterior portion in the axial direction of the coaxial center conductor of the exterior portion by the screw part, and thereby, impedance is easily adjusted by the coaxial center conductor of the exterior portion.

Further, in the coaxial center conductor of the exterior portion included in the structure of the coaxial-to-waveguide transition according to the present invention, the end portion connected to the coaxial center conductor of the interior portion may be provided to be movable within a moving range in the inside of the waveguide. Thereby, impedance in the waveguide can be adjusted.

Further, in the coaxial center conductor of the exterior portion included in the structure of the coaxial-to-waveguide transition according to the present invention, the end portion connected to the coaxial center conductor of the interior portion may be provided to be movable within a moving range in the inside of the coaxial connection part. Thereby, impedance in the coaxial connection part can be adjusted.

Further, in the coaxial center conductor of the exterior portion included in the structure of the coaxial-to-waveguide transition according to the present invention, the end portion connected to the coaxial center conductor of the interior portion is projected to the inside of the waveguide with respect to the axial direction of the coaxial center conductor of the exterior portion, and the end portion is located in the inside of the waveguide. Thereby, impedance in the waveguide can be adjusted.

Further, in the coaxial center conductor of the exterior portion included in the structure of the coaxial-to-waveguide transition according to the present invention, the end portion connected to the coaxial center conductor of the interior portion is projected to the inside of the coaxial connection part with respect to the axial direction of the coaxial center conductor of the exterior portion, and the end portion is located in the inside of the coaxial connection part. Thereby, impedance in the coaxial connection part can be adjusted.

Further, the screw part included in the structure of the coaxial-to-waveguide transition according to the present invention preferably includes a screw member supporting the coaxial center conductor of the exterior portion, a screw hole which is formed in the waveguide and provided so that the screw member is movable, and a restriction part restricting the movement of the screw member so that the screw member is moved only in the inside of the screw hole. According to this configuration, the screw member which is moved inside the screw hole is restricted in movement in the axial direction of the screw member by the restriction part, and therefore, the screw member is not projected to the inside of the waveguide. Therefore, unintended change in impedance by the screw member is prevented, and the occurrence of arcing in the tip end portion of the screw thread inside the waveguide is prevented.

Further, in the coaxial connection part of the structure of the coaxial-to-waveguide transition according to the present invention, a dielectric for adjusting impedance in the coaxial connection part may be provided at a position adjacent to the insulating and sealing member. According to this configuration, the impedance in the vicinity of the insulating and sealing member is varied to a relatively large extent, and therefore, the structure of the coaxial-to-waveguide transition can be easily applied to the other specifications that have different impedances.

A traveling wave tube according to the present invention includes a structure of the coaxial-to-waveguide transition according to the above described present invention.

According to the present invention, the coaxial center conductor of the exterior portion is supported by turning of the screw part provided in the waveguide to be movable in its axial direction, and the coaxial center conductor of the exterior part is moved in its axial direction by adjustment by the screw part, whereby impedance of the structure of the coaxial-to-waveguide transition can be easily adjusted.

DETAILED DESCRIPTION OF THE EXEMPLARY EMBODIMENTS

Hereinafter, concrete exemplary embodiments will be described with reference to the drawings.

In this exemplary embodiment, a structure of a coaxial-to-waveguide transition of the present invention will be described as an output transition section included in a traveling wave tube, but the present invention is not limited to the output side, and may naturally be applied to an input transition section.

First Exemplary Embodiment

Figure 1:
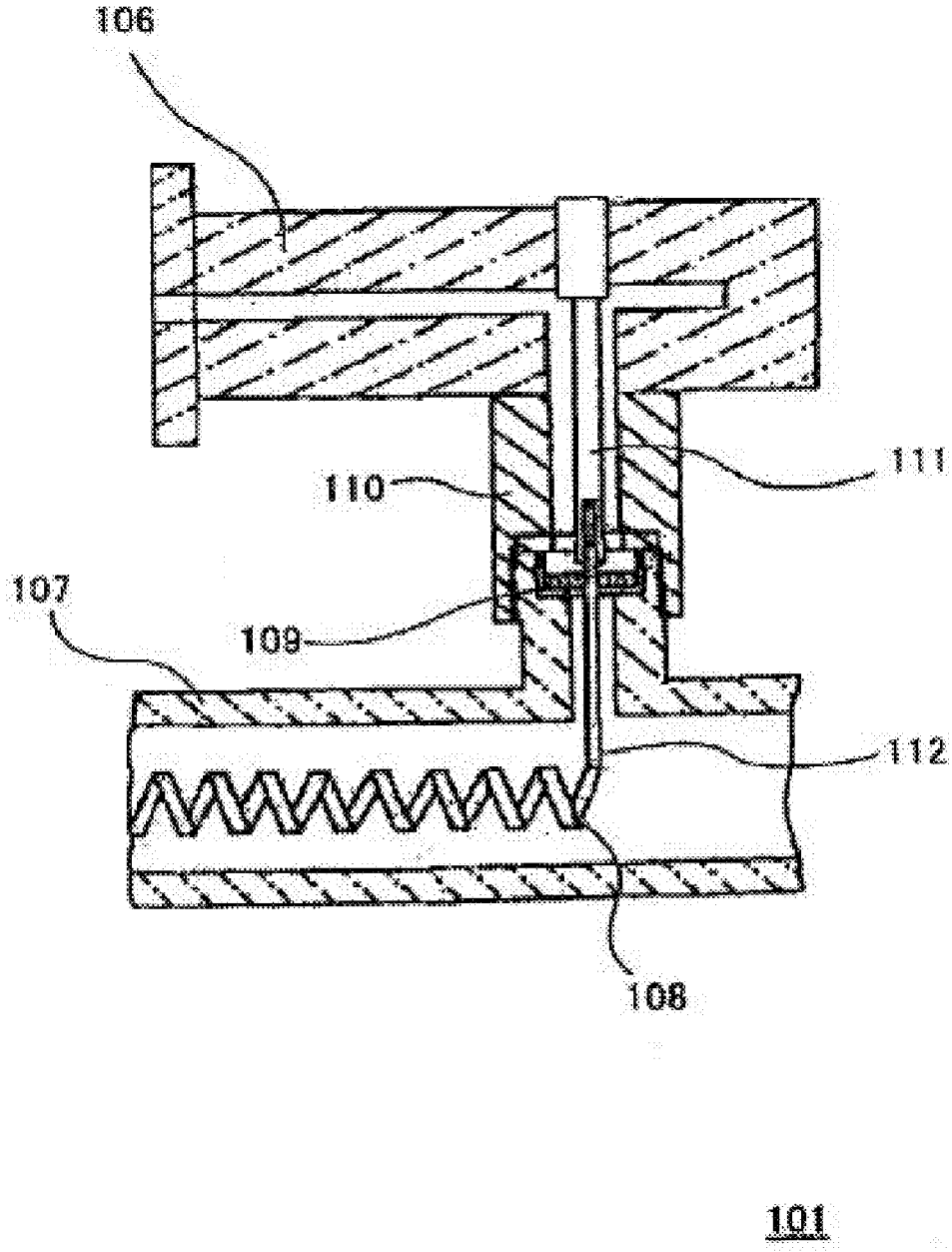
FIG. 1 RELATED ART
FIG. 1 is a sectional view showing a conventional output transition section.
Figure 2:
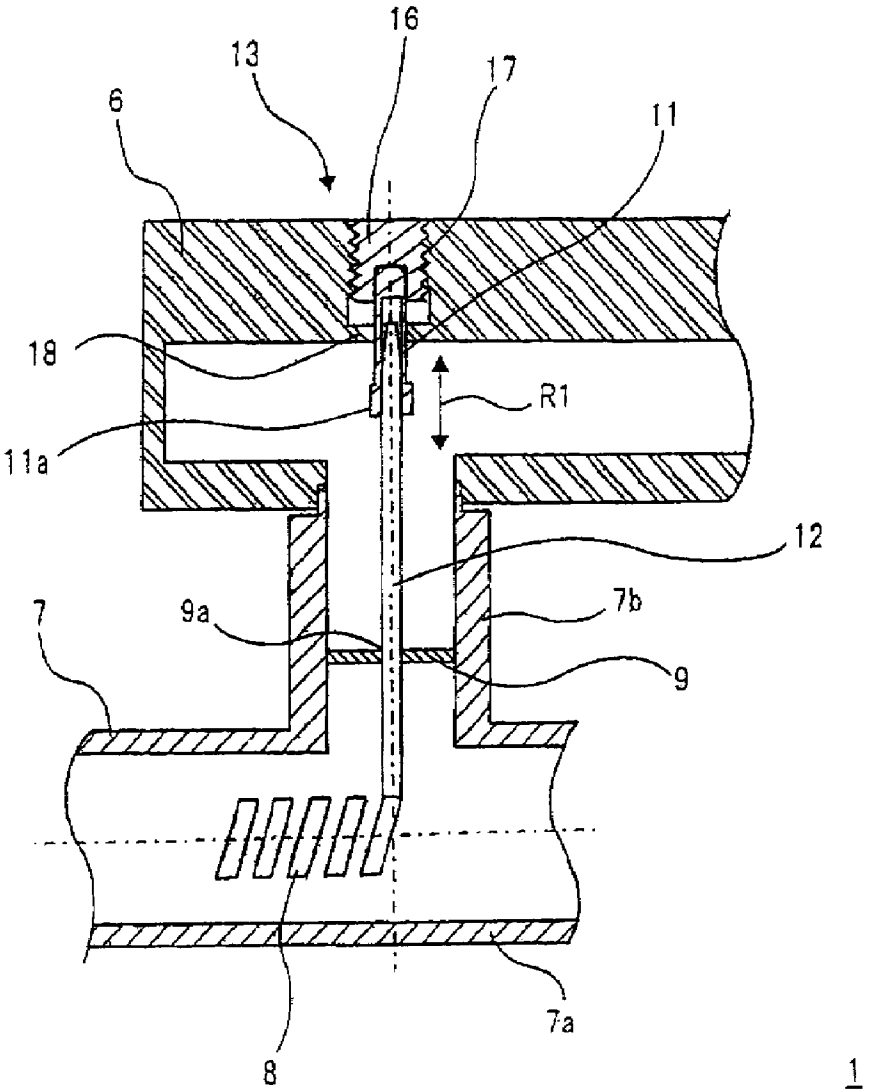
FIG. 2 is a sectional view showing an output transition section of a first exemplary embodiment.
Figure 3:
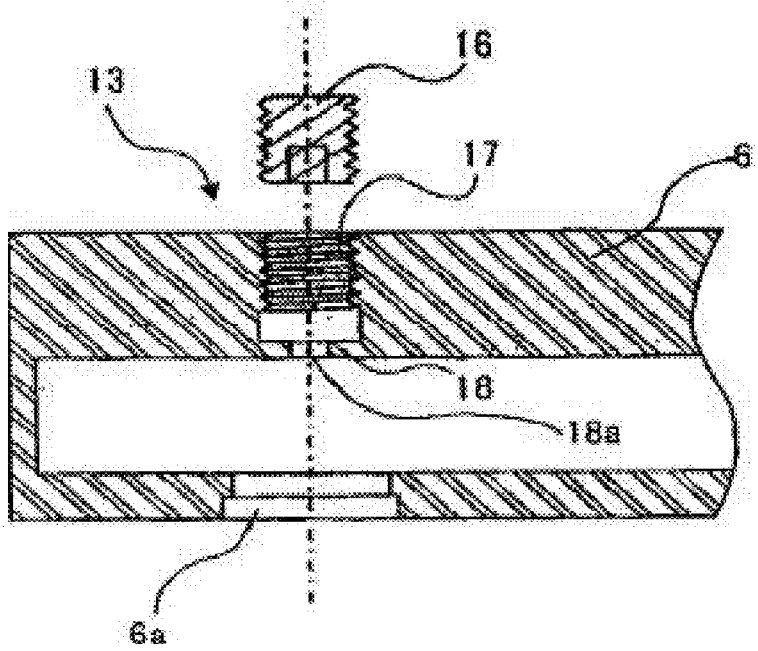
FIG. 3 is an exploded sectional view showing the output transition section of the first exemplary embodiment.
Figure 3:
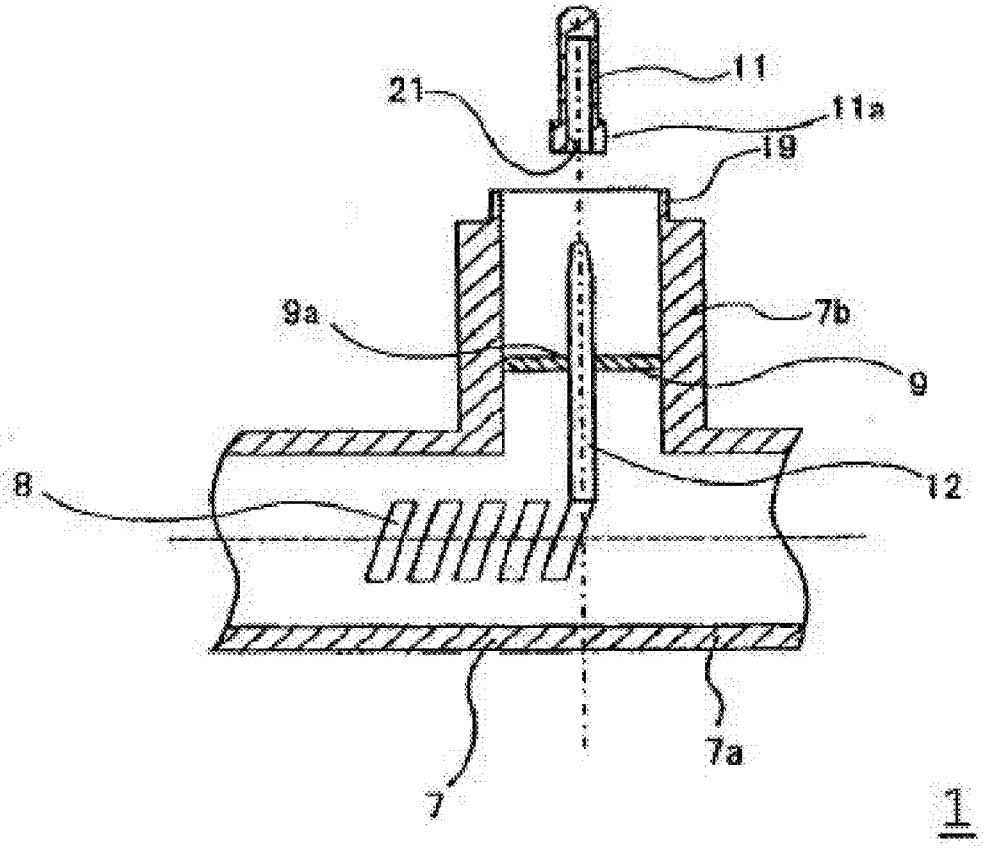

In order to output amplified radio frequency signals, a traveling wave tube includes output transition section 1 as shown in FIG. 2. As shown in FIGS. 2 and 3, output transition section 1 of a first exemplary embodiment includes waveguide 6 for outputting radio frequency signals, vacuum envelope 7 provided with slow-wave circuit 8 in the interior of the vacuum, insulating window member (insulating and sealing member) 9 which hermetically seals a side of vacuum envelope 7 and a side of waveguide 6, coaxial center conductor of exterior portion 11 with one end supported by waveguide 6, and coaxial center conductor of interior portion 12 with one end abutting on slow-wave circuit 8 and the other end connected to coaxial center conductor of exterior portion 11.

Waveguide 6 of output transition section 1 is formed by a metal material, and is provided with connection hole 6*a* to which coaxial connection part 7*b* of vacuum envelope 7, which will be described later, is connected, as shown in FIG. 3. Waveguide 6 is provided with screw part 13 which supports coaxial center conductor of exterior portion 11 movably in the axial direction of coaxial center conductor of exterior portion 11.

Screw part 13 includes screw member 16 which supports one end portion of the coaxial center conductor of exterior portion 11, screw hole 17 which is formed in waveguide 6 so that screw member 16 is movable, and restricting part 18 which restricts movement of screw member 16 so that screw member 16 is moved in only the inside of screw hole 17.

In screw member 16 of screw part 13, a groove in which a screw driver is engaged is formed in a head portion located at an outer peripheral portion side of waveguide 6 though not illustrated. Restricting part 18 of screw part 13 is formed at one end side of screw hole 17 integrally with the inner wall of waveguide 6. Bearing hole 18*a* (FIG. 3) through which the coaxial center conductor of exterior portion 11 is movably inserted is formed in restricting part 18.

Accordingly, when the coaxial center conductor of exterior portion 11 is moved in the axial direction of the coaxial center conductor of exterior portion 11, screw member 16 which is moved in the axial direction of screw member 16 abuts on restricting part 18, so that screw part 13 is constructed not to be projected to the inside of waveguide 6. Therefore, the impedance in waveguide 6 is prevented from changing as a result of screw member 16 projecting to the inside of waveguide 6.

Vacuum envelope 7 of output transition section 1 is formed by a metal material, and includes vacuum tube part 7*a* with helix slow-wave circuit 8 disposed in the inside, and coaxial connection part 7*b* which is formed integrally with vacuum tube part 7*a* and which is connected to waveguide 6. Engaging piece 19 which is engaged with connection hole 6*a* of waveguide 6 is provided at the end portion of coaxial connection part 7*b* to be elastically displaceable.

The coaxial center conductor of exterior portion 11 is formed into a rod shape by a conductive material, and includes bearing hole 21 (FIG. 3) in which the end portion of the coaxial center conductor of interior portion 12 is inserted movably in the axial direction of the coaxial center conductor of exterior portion 11. The coaxial center conductor of exterior portion 11 is divided into a plurality of portions so that the peripheral wall of bearing hole 21 is elastically deformable in the diameter direction, and the end portion of the coaxial center conductor of interior portion 12 is inserted into bearing hole 21, whereby the peripheral wall which is elastically displaced is caused to abut on the outer peripheral surface of the coaxial center conductor of interior portion 12 favorably. Further, in the coaxial center conductor of exterior portion 11, the outside diameter of end portion 11*a* located in the inside of waveguide 6 is formed to be large.

The coaxial center conductor of exterior portion 11 is formed to be of a predetermined length so that when the coaxial center conductor of exterior portion 11 is moved in the axial direction of the coaxial center conductor of exterior portion 11 by turning of screw part 13, end portion 11*a* connected to the coaxial center conductor of interior portion 12 displaces within moving range R1 in the inside of waveguide 6. In the coaxial center conductor of exterior portion 11, end portion 11*a* whose outside diameter is formed to be large is moved in the axial direction of the coaxial center conductor of exterior portion 11 in the inside of waveguide 6, and thereby, the impedance in waveguide 6 is adjusted to a relatively large extent.

The coaxial center conductor of interior portion 12 is formed into a rod shape by a conductive material, and is formed to have a predetermined length corresponding to the length of the coaxial center conductor of exterior portion 11. In the coaxial center conductor of interior portion 12, one end abuts on an end portion of slow-wave circuit 8, and the other end is connected to the coaxial center conductor of exterior portion 11.

Insulating window member 9 is formed into a disk shape by an insulating material such as ceramics, and is provided to be fixed to coaxial connection part 7*b*. Insertion hole 9*a* through which the coaxial center conductor of interior portion 12 is inserted is provided in the center of insulating window member 9, and the coaxial center conductor of interior portion 12 is fixed to insertion hole 9*a*.

About output transition section 1 which is configured as above, an operation of moving the position of end portion 11*a* of the coaxial center conductor of exterior portion 11 in the axial direction of the coaxial center conductor of exterior portion 11 will be described.

In screw part 13, screw member 16 is moved along screw hole 17 with a screw driver or the like, and thereby, the coaxial center conductor of exterior portion 11 is moved in the axial direction of the coaxial center conductor of exterior portion 11 together with screw member 16. As the coaxial center conductor of exterior portion 11 is moved along its axial direction, the end portion of the coaxial center conductor of interior portion 12 fixed to a side of vacuum envelope 7 is moved with respect to bearing hole 21 of the coaxial center conductor of exterior portion 11. At this time, when end portion 11*a* of the coaxial center conductor of exterior portion 11 is moved with respect to the axial direction of the coaxial center conductor of exterior portion 11, end portion 11*a* is kept in a favorable connection state with the end portion of the coaxial center conductor of interior portion 12.

Further, in screw member 16 which is moved inside screw hole 17, the tip end abuts on restricting part 18 and movement in the axial direction of screw member 16 is restricted, and therefore, it is not projected to the inside of waveguide 6. Therefore, unintended change in impedance caused by screw member 16 is prevented, and in the inside of waveguide 6, the occurrence of radio frequency arcing in the tip end portion of the screw thread of screw member 16 is also prevented.

The coaxial center conductor of exterior portion 11 is moved in the axial direction of the coaxial center conductor of exterior portion 11, and thereby, the position of end portion 11*a* connected to the coaxial center conductor of interior portion 12 is moved within moving range R1 (FIG. 2) in the inside of waveguide 6. By this movement, in the coaxial center conductor of exterior portion 11, the projected amount in the axial direction of the coaxial center conductor of exterior portion 11 with respect to the inside of waveguide 6, that is, the relative position of end portion 11*a* of the coaxial conductor of exterior portion 11 with respect to waveguide 6 is changed, and therefore, the impedance in waveguide 6 is easily adjusted by the coaxial center conductor of exterior portion 11.

Finally, the coaxial center conductor of exterior portion 11, whose position in the axial direction of the coaxial center conductor of exterior portion 11 is adjusted, is fixed by screw member 16 being bonded to screw hole 17 by the end portion of screw member 16 being coated with, for example, a coating material, an adhesive or the like.

As described above, in output transition section 1 of this exemplary embodiment, the position of end portion 11*a* of the coaxial center conductor of exterior portion 11 is made movable within moving range R1 in the inside of waveguide 6 by screw part 13. Thereby, irrespective of variations in the outside dimensions due to machining inaccuracy, dimensional tolerance and the like of the components configuring output transition section 1, the impedance in waveguide 6 can be easily adjusted to an optimal value. Therefore, according to the traveling wave tube which includes output transition section 1, the operation of selectively assembling the components which include the coaxial center conductors of the exterior portions differing in outside dimension is not involved as in the above described related output transition section. Therefore, according to the traveling wave tube according to the exemplary embodiment, the operation of adjusting the impedance in waveguide 6 is simplified, and the manufacturing cost of the traveling wave tube can be reduced.

Next, an output transition section of another exemplary embodiment will be described with reference to the drawings. The other exemplary embodiment has the same basic configuration as in the above described first exemplary embodiment except for the configuration of the coaxial center conductor of the exterior portion which is adjusted by screw part 13, and therefore, explanation will be omitted by assigning the same members with the same reference numerals and characters as in the first exemplary embodiment.

Second Exemplary Embodiment

Figure 4:
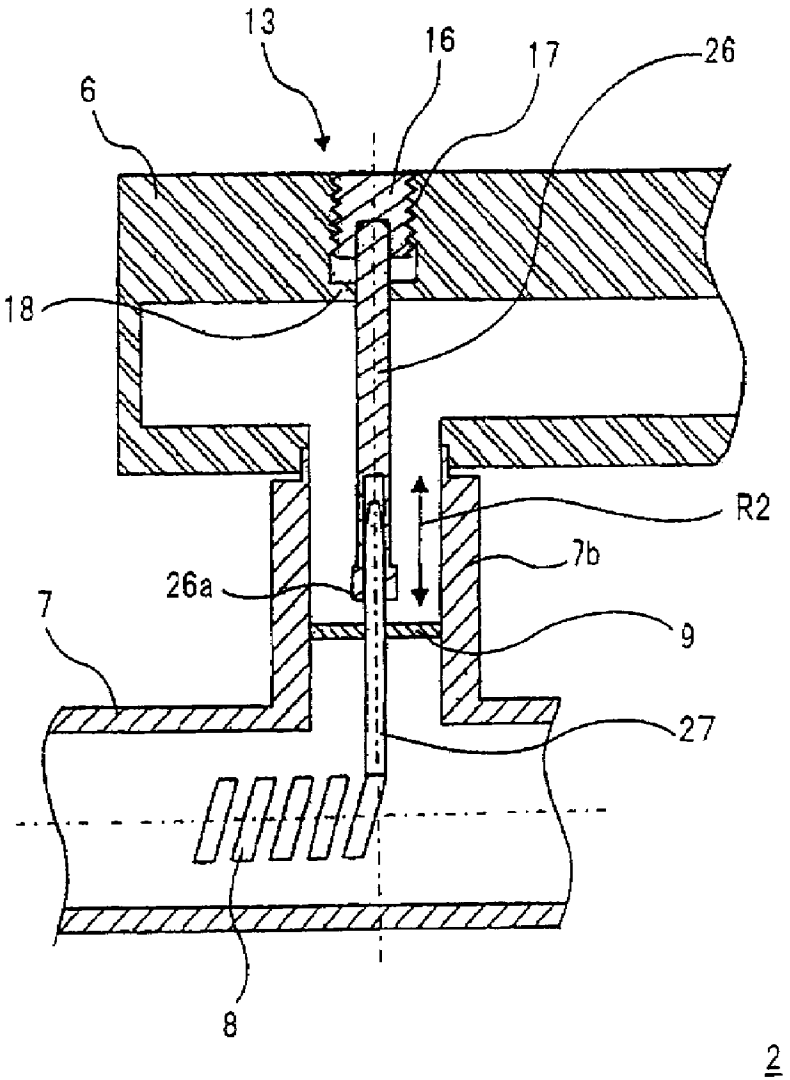
FIG. 4 is a sectional view of an output transition section of a second exemplary embodiment.

As shown in FIG. 4, output transition section 2 of a second exemplary embodiment includes the coaxial center conductor of exterior portion 26 with one end supported by waveguide 6, and the coaxial center conductor of interior portion 27 with one end abutting on slow-wave circuit 8 and the other end connected to the coaxial center conductor of exterior portion 26.

The coaxial center conductor of exterior portion 26 is formed to have a predetermined length so that when it is moved in the axial direction of the coaxial center conductor of exterior portion 26 by screw part 131 end portion 26*a* formed to have a large outside diameter is displaced within moving range R2 in the inside of coaxial connection part 7*b* of vacuum envelope 7. The coaxial center conductor of interior portion 27 is formed to have a predetermined length corresponding to the length of the coaxial center conductor of exterior portion 26.

In output transition section 2 configured as above, the position of end portion 26*a* of the coaxial center conductor of exterior portion 26 is moved within moving range R2 in the inside of coaxial connection part 7*b* of vacuum envelope 7 by moving screw member 16 of screw part 13 as in the operation of adjusting the impedance in the above described first exemplary embodiment. The position of end portion 26*a* of the coaxial center conductor of exterior portion 26 is moved within moving range R2, and thereby, impedance in the coaxial connection part 7*b* is adjusted.

As described above, output transition section 2 of this exemplary embodiment is configured so that the position of end portion 26*a* of the coaxial center conductor of exterior portion 26 is movable within moving range R2 in the inside of coaxial connection part 7*b* of vacuum envelope 7. Thereby, in output transition section 2, impedance in coaxial connection part 7*b* of vacuum envelope 7 can be easily adjusted to an optimal value. Therefore, according to the traveling wave tube that includes output transition section 2, the operation of adjusting the impedance in waveguide 6 is simplified, and the manufacturing cost of the traveling wave tube can be reduced.

Third Exemplary Embodiment

Figure 5:
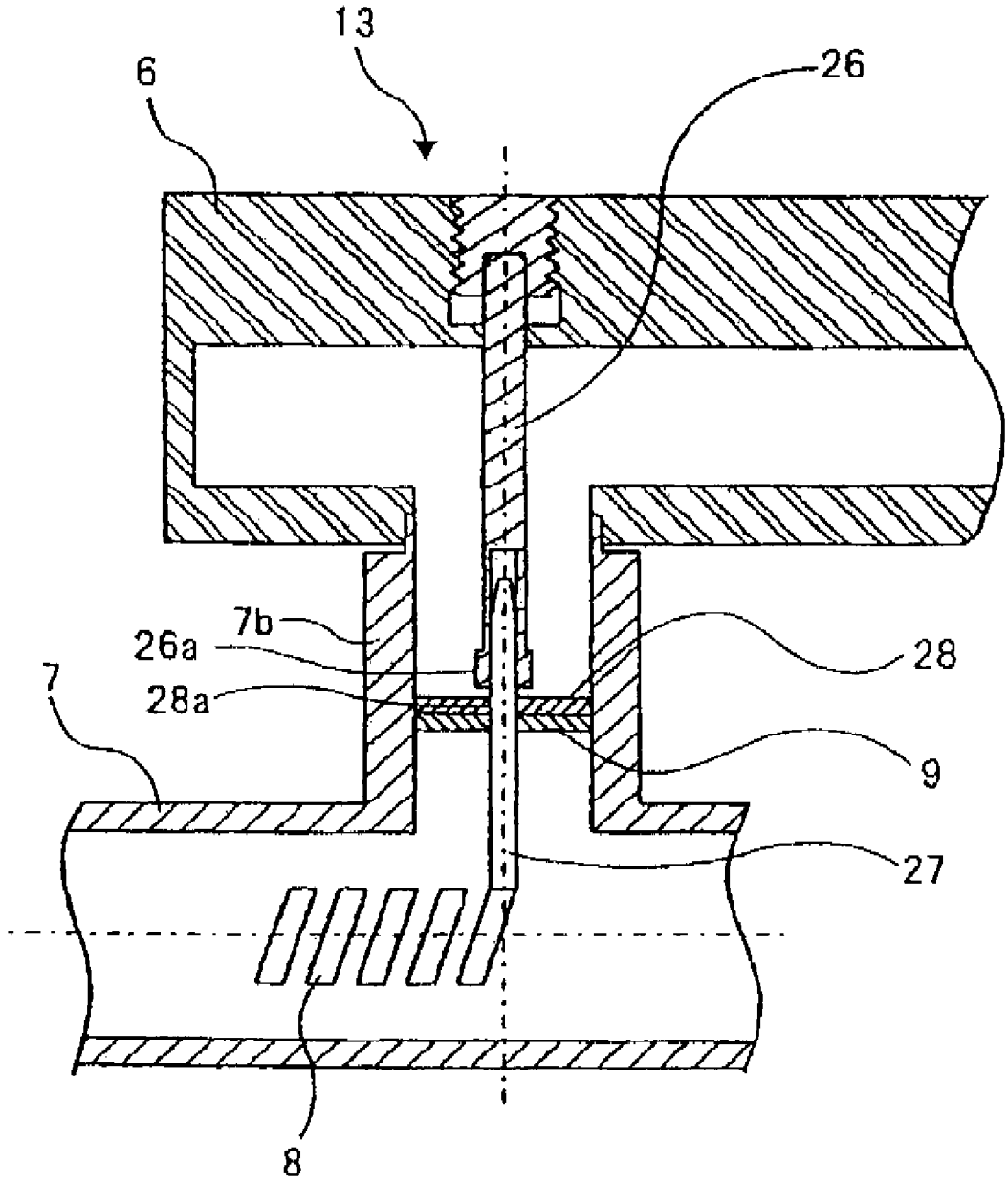
FIG. 5 is a sectional view showing an output transition section of a third exemplary embodiment.

As shown in FIG. 5, in addition to the configuration of the second exemplary embodiment, output transition section 3 of a third exemplary embodiment includes dielectric 28 for varying impedance in the vicinity of insulating window member 9 inside coaxial connection part 7*b* of vacuum envelope 7 to a relatively large extent, that is, for shifting the impedance.

Dielectric 28 is formed into a disk shape by a dielectric material such as, for example, polytetrafluoroethylene, and is disposed at the position adjacent to insulating window member 9. Insertion hole 28*a* through which coaxial center conductor of interior portion 27 is inserted is provided in a central portion of dielectric 28.

According to output transition section 3 of this exemplary embodiment, by properly changing the outside dimension such as thickness and the material of dielectric 28 when necessary, the impedance is shifted to a relatively large extent, and output transition section 3 can be easily applied to other specifications that have different impedances.

In output transition sections 1, 2 and 3 of the above described exemplary embodiments, the thickness of the sidewall where screw part 13 is provided is formed to be larger as compared with the opposite sidewall in waveguide 6. However, the present invention is not limited to this configuration, and the thickness of the sidewall may be made uniform and only the screw part may be configured to be thicker than the sidewall.

Further, the structure of the coaxial-to-waveguide transition according to the present invention is preferably applied to a traveling wave tube having an output of 1 kW or less, for example, from about several tens W to several hundreds W.

While this invention has been shown and described with particular reference to exemplary embodiments thereof, the invention is not limited to these embodiments. It will be understood by those of ordinary skill in the art that various changes in form and details may be made therein without departing from the spirit and scope of the present Invention as defined by the claims.

What is claimed is:

1. A structure of a coaxial-to-waveguide transition, comprising:

a waveguide for inputting or outputting a radio frequency wave;

a vacuum envelope provided with a slow-wave circuit;

a coaxial connection part connecting said waveguide and said vacuum envelope;

an insulating and sealing member which is provided in said coaxial connection part, and which hermetically seats a side of said vacuum envelope and a side of said waveguide;

a coaxial center conductor of an exterior portion with one end supported by said waveguide; and a coaxial center conductor of an interior portion with one end abutting on said slow-wave circuit and the other end connected to said coaxial center conductor of the exterior portion, wherein said waveguide is provided with a screw part supporting said coaxial center conductor of said exterior portion movably in an axial direction of said coaxial center conductor of said exterior portion, and an end portion of said coaxial center conductor of said exterior portion is connected to the other end of said coaxial center conductor of said interior portion movably in an axial direction of said coaxial center conductor of said exterior portion, wherein in said coaxial center conductor of said exterior portion, the end portion connected to said coaxial center conductor of said interior portion is projected to an interior of said waveguide with respect to the axial direction of said coaxial center conductor of said exterior portion, and said end portion is located in the interior of said waveguide.

2. A traveling wave tube, comprising the structure of the coaxial-to-waveguide transition according to claim 1.

3. The structure of the coaxial-to-waveguide transition according to claim 1, wherein said screw part includes a screw member supporting said coaxial center conductor of said exterior portion, a screw hole which is disposed in said waveguide and which is provided so that said screw member is movable, and a restriction part restricting the movement of said screw member so that said screw member is moved in only an interior of said screw hole.

4. The structure of the coaxial-to-waveguide transition according to claim 1, wherein in said coaxial connection part, a dielectric for adjusting impedance in said coaxial connection part is provided at a position adjacent to said insulating and sealing member.

5. A structure of a coaxial-to-waveguide transition, comprising:

a waveguide for inputting or outputting a radio frequency wave;

a vacuum envelope provided with a slow-wave circuit;

a coaxial connection part connecting said waveguide and said vacuum envelope;

an insulating and sealing member which is provided in said coaxial connection part, and which hermetically seals a side of said vacuum envelope and a side of said waveguide;

a coaxial center conductor of an exterior portion with one end supported by said waveguide; and a coaxial center conductor of an interior portion with one end abutting on said slow-wave circuit and the other end connected to said coaxial center conductor of the exterior portion, wherein said waveguide is provided with a screw part supporting said coaxial center conductor of said exterior portion movably in an axial direction of said coaxial center conductor of said exterior portion, and an end portion of said coaxial center conductor of said exterior portion is connected to the other end of said coaxial center conductor of said interior portion movably in an axial direction of said coaxial center conductor of said exterior portion, wherein in said coaxial center conductor of said exterior portion, the end portion connected to said coaxial center conductor of said interior portion is provided to be movable within a moving range in an interior of said wave guide.

6. The structure of the coaxial-to-waveguide transition according to claim 5, wherein said screw part includes a screw member supporting said coaxial center conductor of said exterior portion, a screw hole which is disposed in said waveguide and which is provided so that said screw member is movable, and a restriction part restricting the movement of said screw member so that said screw member is moved in only an interior of said screw hole.

7. The structure of the coaxial-to-waveguide transition according to claim 5, wherein in said coaxial connection part, a dielectric for adjusting impedance in said coaxial connection part is provided at a position adjacent to said insulating and sealing member.

8. A traveling wave tube, comprising the structure of the coaxial-to-waveguide transition according to claim 5.

* * * * *